United States Patent [19]

Kubodera et al.

[11] Patent Number: 4,965,181

[45] Date of Patent: Oct. 23, 1990

[54] HEAT-DEVELOPABLE LIGHT-SENSITIVE MATERIAL COMPRISING A SENSITIZING DYE

[75] Inventors: Seiiti Kubodera; Akihiko Ikegawa; Masaki Okazaki, all of Kanagawa, Japan

[73] Assignee: Fuji Photo Film Co., Ltd., Kanagawa, Japan

[21] Appl. No.: 492,266

[22] Filed: Feb. 28, 1990

Related U.S. Application Data

[63] Continuation of Ser. No. 127,143, Dec. 1, 1987, abandoned.

[30] Foreign Application Priority Data

Dec. 1, 1986 [JP] Japan ..... 61-286424

[51] Int. Cl.[5] ..... G03C 1/19; G03C 1/28; G03C 1/40

[52] U.S. Cl. ..... 430/550; 430/559; 430/588; 430/617

[58] Field of Search ..... 430/550, 559, 588, 607

[56] References Cited

U.S. PATENT DOCUMENTS

| | | | |
|---|---|---|---|
| 4,362,813 | 12/1982 | Mihara et al. | 430/550 |
| 4,551,424 | 11/1985 | Ikeda et al. | 430/591 |
| 4,639,408 | 1/1987 | Kitaguchi et al. | 430/617 |
| 4,668,612 | 5/1987 | Hirai | 430/523 |
| 4,889,796 | 12/1989 | Ikegawa et al. | 430/549 |

*Primary Examiner*—Paul R. Michl
*Assistant Examiner*—Patrick Doody
*Attorney, Agent, or Firm*—Sughrue, Mion, Zinn, Macpeak & Seas

[57] ABSTRACT

A heat-developable light-sensitive material comprising a support having provided thereon a light-sensitive layer comprising a silver halide which is spectrally sensitized with at least one dye represented by formula (I):

(I)

$(X)_n$ wherein $R_0$ and $R_1$, which may be the same or different, each represents a hydrogen atom, an alkyl group, an aryl group, an alkoxy group, an aryloxy group, a halogen atom, an alkoxycarbonyl group, an acylamino group, an acyl group, a cyano group, a carbamoyl group, a sulfamoyl group, a carboxyl group, or an acyloxy group; provided that at least one of $R_0$ and $R_1$ represents a group other than a hydrogen atom; $R_2$ represents a hydrogen atom, an alkyl group, or an aryl group; $R_3$ represents an alkyl group, an aryl group, an alkoxy group, an aryloxy group, an acyl group, an acyloxy group, an alkoxycarbonyl group, or an acylamino group; provided that when $R_3$ represents an aryl group, $R_0$ and $R_1$ each represents a group other than an aryl group; the group represented by $R_3$ has a value of S of 544 or less wherein S is represented by formula (Z):

$$S=3.536L-2.661B+535.4 \quad (Z)$$

wherein L represents the length of the group $R_3$ along the axis of the bond between the group $R_3$ and the center of the benzene nucleus to which the group $R_3$ is connected, and B represents the smaller value of $B_1+B_4$ and $B_2+B_3$ wherein $B_1$, $B_2$, $B_3$, and $B_4$ each represents the width of the group $R_3$ which are measured at their maximum points and perpendicular to said axis and each other, provided that $B_1$ is the smallest value and $B_2$, $B_3$, and $B_4$ are successively larger; $R_4$ and $R_5$, which may be the same or different, each represents an alkyl group; X represents an anion; and n is 0 or 1, as required to satisfy charge balance.

21 Claims, No Drawings

HEAT-DEVELOPABLE LIGHT-SENSITIVE MATERIAL COMPRISING A SENSITIZING DYE

This is a continuation of application Ser. No. 127,143, filed Dec. 1, 1987, now abandoned.

FIELD OF THE INVENTION

The present invention relates to heat developable light-sensitive materials, and more particularly to heat developable light-sensitive materials improved in storage stability and reciprocity law failure characteristics.

BACKGROUND OF THE INVENTION

Heat developable light-sensitive materials are well known in the art, and heat developable light-sensitive materials and their processes are described, for example, in *Shashin Koqyo no Kiso* (Fundamentals of Photographic Industry), pages 553 to 555, (1979, Koronasha); *Eizo Joho* (Image Information), page 40 (April 1978); *Nebletts' Handbook of Photography and Reprography*, pages 32 to 33 (7th edition, Van Nortrand Reinhold Company); U.S. Pat. Nos. 3,152,904, 3,301,678, 3,392,020, and 3,457,075; British Pat. Nos. 1,131,108, and 1,167,777; and Research Disclosure, June 1978, pages 9 to 15 (RD-17029).

Many techniques of providing color images have been suggested, including, for example, methods in which a color image is formed by combining the oxidation product of a developer and a coupler; methods in which a positive color image is formed by the light-sensitive silver-dye bleaching technique; and methods in which an image is formed by heat development, using a compound which has a dye portion and can release a mobile dye corresponding to or counter-corresponding to the reduction reaction of a silver halide to silver at a high temperature as disclosed, for example, in U.S. Pat. No. 4,500,626, European Patent Application Nos. 76,492A, and 79,056A, and Japanese Patent Application (OPI) Nos. 28928/83, and 26008/83 (the term "OPI", as used herein, refers to a "published unexamined Japanese patent application").

In these methods for forming an image, generally, to facilitate development when the heat-developable light-sensitive material is heated, an alkali agent or a precursor thereof, or an organic silver salt is incorporated in the heat developable light-sensitive material. However, a light-sensitive material containing a silver halide emulsion color-sensitized with a sensitizing dye together with an alkali agent or a precursor thereof, or an organic silver salt has the serious disadvantage that its sensitivity decreases during storage.

In the system containing a compound with a dye moiety which can release a mobile dye corresponding to or counter-corresponding to the reduction reaction of a silver halide to silver at a high temperature, when a color-sensitized silver halide is used, the storage stability of the light-sensitive material is very seriously decreased. It is assumed that because the dye releasing compound itself has a dye portion and properties similar to those of dyes, when it is used with a silver halide sensitized with a sensitizing dye, an interaction occurs between the dye releasing compound and the sensitizing dye adsorbed on the silver halide, and the sensitizing dye separates from the silver halide surface during the storage. This defect is a serious disadvantage in color light-sensitive materials and light-sensitive materials for electromagnetic radiation in regions outside the inherent sensitivity of silver halides.

Since photographic materials employing these image forming methods can be easily processed and can provide high quality images, they are used as printing materials in many fields, and can be used, for example, in the field of design of products such as electric appliances, automobiles, building materials, apparel, interior decoration, and crafted products; in the field of color scheme design of styles, designs, textiles, etc.; in the field of trade samples of real estate, decorative items, fashions, makeup, etc.; in the field of scientific analysis such as analysis of structures of molecular models, remote sensing, simulation, etc.; in the field of entertainment such as computer animation, computer art, etc.; in the field of medical images obtained by CCD autoscopes, microscopes, etc.; in the field of printing used for block copies, proofs, etc.; and in the field of duplicate prints, color telephotography, and high quality TV.

SUMMARY OF THE INVENTION

An object of the invention is to provide a heat developable light-sensitive material which are high in stability.

Another object of the invention is to provide a storage stable heat sensitive material in which a prescribed sensitivity can be kept even when they are stored for a long period of time.

Further object of the invention is to provide a heat developable light-sensitive material excellent in reciprocity law failure characteristics.

Other and further objects of the present invention will appear more fully from the following description.

It has now been found that the objects of the present invention can be attained by a heat developable light-sensitive material comprising a support having provided thereon a light-sensitive layer containing a silver halide and at least one dye represented by formula (I):

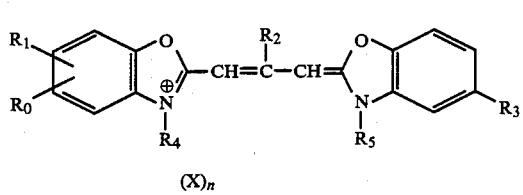

(I)

wherein $R_0$ and $R_1$, which may be the same of different, each represents a hydrogen atom, an alkyl group, an aryl group, an alkoxy group, an aryloxy group, a halogen atom, an alkoxycarbonyl group, an acylamino group, an acyl group, a cyano group, a carbamoyl group, a sulfamoyl group, a carboxyl group, or an acyloxy group; provided that at least one of $R_0$ and $R_1$ represents a group other than a hydrogen atom; $R_2$ represents a hydrogen atom, an alkyl group, or an aryl group; $R_3$ represents an alkyl group, an aryl group, an alkoxy group, an aryloxy group, an acyl group, an acyloxy group, an alkoxycarbonyl group, or an acylamino group; provided that when $R_3$ represents an aryl group, $R_0$ and $R_1$ each represents a group other than an aryl group; the group represented by $R_3$ has a value of S of 544 or less wherein S is represented by formula (Z):

$$S=3.536L-2.661B+535.4 \quad (Z)$$

wherein L represents the length of the group $R_3$ along the axis of the bond between the group $R_3$ and the center of the benzene nucleus to which the group $R_3$ is connected, and B represents the smaller valve of $B_1+B_4$ and $B_2+B_3$ wherein $B_1$, $B_2$, $B_3$, and $B_4$ each represents the width of the group $R_3$ which are measured at their maximum points and perpendicular to said axis and each other, provided that $B_1$ is the smallest value and $B_2$, $B_3$, and $B_4$ are successively larger; $R_4$ and $R_5$, which may be the same of different, each represents an alkyl group; X represents an anion, and n is 0 or 1 as required to satisfy charge balance.

DETAILED DESCRIPTION OF THE INVENTION

The alkyl groups represented by $R_0$ and $R_1$ include substituted alkyl groups and preferably have up to 10 carbon atoms (e.g., a methyl group, an ethyl group, a propyl group, an isopropyl group, a butyl group, a branched butyl group such as an isobutyl group and a t-butyl group, a pentyl group, a branched pentyl group such as an isopentyl group, and a t-pentyl group, a vinylmethyl group, a cyclohexyl group, a benzyl group, a phenethyl group, a 3-phenylpropyl group, and a trifluoromethyl group).

The aryl groups represented by $R_0$ and $R_1$ include substituted aryl groups and preferably have up to 10 carbon atoms (e.g., a phenyl group, a 4-methyphenyl group, a 4-chlorophenyl group, and a naphthyl group).

The alkoxy groups represented by $R_0$ and $R_1$ include substituted alkoxy groups and preferably have up to 10 carbon atoms (e.g., a methoxy group, an ethoxy group, a propyloxy group, a butyloxy group, a pentyloxy group, a benzyloxy group, and a phenetyloxy group).

The aryloxy groups represented by $R_0$ and $R_1$ include substituted aryloxy groups and preferably have up to 10 carbon atoms (e.g., a phenoxy group, a 4-methylphenoxy group, a 4-chlorophenoxy group, and a naphthyloxy group).

The halogen atoms represented by $R_0$ and $R_1$ include, for example, a fluorine atom, a chlorine atom, a bromine atom, and an iodine atom.

The alkoxycarbonyl groups represented by $R_0$ and $R_1$ include substituted alkoxycarbonyl groups and preferably have up to 10 carbon atoms (e.g., a methoxycarbonyl group, an ethoxycarbonyl group, and a benzyloxycarbonyl group).

The acylamino groups represented by $R_0$ and $R_1$ include substituted acylamino groups and preferably have up to 8 carbon atoms (e.g., an acetylamino group, a trifluoroacetylamino group, a propionylamino group, and a benzoylamino group).

The acyl groups represented by $R_0$ and $R_1$ include substituted acyl groups and preferably have up to 10 carbon atoms (e.g., an acetyl group, a trifluoroacetyl group, a propionyl group, a benzoyl group, and a mesyl group).

The carbamoyl groups represented by $R_0$ and $R_1$ include substituted carbamoyl groups and preferably have up to 6 carbon atoms (e.g., a carbamoyl group, an N,N-dimethylcarbamoyl group, and a morpholinocarbonyl group).

The sulfamoyl groups represented by $R_0$ and $R_1$ include substituted sulfamoyl groups and preferably have up to 6 carbon atoms (e.g., a sulfamoyl group, an N,N-dimethylsulfamoyl group, a morpholinosulfonyl group, and a piperidinosulfonyl group).

The acyloxy groups represented by $R_0$ and $R_1$ include substituted acyloxy groups and preferably have up to 10 carbon atoms (e.g., an acetyloxy group, a trifluoroacetyloxy group, a propionyloxy group, and a benzoyloxy group).

$R_0$ and $R_1$ may represent a hydrogen atom, a cyano group, or a carboxy group, provided that $R_0$ and $R_1$ do not both represent a hydrogen atom. The substitution position of $R_0$ and $R_1$ is preferably the 5-position or the 6-position of the benzoxazole ring. It is most preferred that $R_0$ represent a hydrogen atom and $R_1$ represent a phenyl group which is substituted at the 5-position of the benzoxazole ring.

The alkyl groups and aryl groups represented by $R_2$ include those substituted with various substituents and preferably alkyl groups having up to 4 carbon atoms (e.g., a methyl group, an ethyl group, a propyl group, a butyl group, a benzyl group, a phenethyl group, and a 3phenylpropyl group), and aryl groups having up to 10 carbon atoms (e.g., a phenyl group, and a p-tolyl group). $R_2$ may be a hydrogen atom.

The alkyl groups, aryl groups, alkoxy groups, aryloxy groups, acyl groups, acyloxy groups, alkoxy-carbonyl groups and acylamino groups represented by $R_3$ include those substituted with various substituents.

Preferably, $R_3$ represents an alkyl group having 2 or more carbon atoms, an alkoxy group having 2 or more carbon atoms, an acyl group having 3 or more carbon atoms, an acyloxy group having 3 or more carbon atoms, an alkoxycarbonyl group having 4 or more carbon atoms or an acylamino group having 3 or more carbon atoms.

Preferred examples of $R_3$ include, for example, an ethyl group, a propyl group, an isopropyl group, a branched butyl group (e.g., a t-butyl group), a branched pentyl group (e.g., an isopentyl group, and a t-pentyl group), a branched hexyl group (e.g., a 3,3-dimethylbutyl group), a cyclohexyl group, a branched octyl group (e.g., a t-octyl group), an aryl-substituted alkyl group (e.g., a benzyl group, and a phenethyl group), and a t-butylcarbonyloxy group. The most preferred examples of $R_3$ are an ethyl group, a propyl group, an isopropyl group, a t-butyl group, a t-pentyl group, a cyclohexyl group, a t-octyl group, and a benzyl group.

The group represented by $R_3$ has a value of S of 544 or less, preferably from 500 to 544 wherein S is represented by formula (Z):

$$S=3.536L-2.661B+535.4 \quad (Z)$$

wherein L represents the length (in terms of Å) of the group $R_3$ along the axis of the bond between the group $R_3$ and the center of the benzene nucleus to which the group $R_3$ is Connected, and B represents the smaller value of $B_1+B_4$ and $B_2+B_3$ wherein $B_1$, $B_2$, $B_3$, and $B_4$ each represents the width (in terms of Å) of the group $R_3$ which are measured at their maximum points and perpendicular to the above-mentioned axis and each other, provided that $B_1$ is the smallest value and $B_2$, $B_3$, and $B_4$ are successively larger.

L, $B_1$, $B_2$, $B_3$, and $B_4$ represent Sterimol parameters in terms of Å including consideration of standard bond angles, van der Waals radii, bond lengths, and conformations of the group $R_3$ in space.

The detailed explanation of Sterimol parameters and those for particular groups are described, for example, in *Drug Design,* Volume III, pages 17 to 20, by A. Verloop, W. Hogensteraaten, and J. Tipker, edited by E. J. Ariens, (Academic Press, New York 1979) which is incorporated herein and made a reference hereof.

The alkyl groups represented by $R_4$ and $R_5$ include substituted alkyl groups and preferably are unsubstituted alkyl groups having up to 8 carbon atoms (e.g., a methyl group, an ethyl group, a propyl group, a vinylmethyl group, a butyl group, a pentyl group, a hexyl group, a heptyl group, and an octyl group); aralkyl groups having up to 10 carbon atoms (e.g., a benzyl group, a phenethyl group, and a 3-phenylpropyl group); and alkyl groups having up to 6 carbon atoms that are substituted by a hydroxyl group, a carboxyl group, a sulfo group, a cyano group, a halogen atom (e.g., a fluorine atom, a chlorine atom and a bromine atom), an alkoxycarbonyl group having up to 8 carbon atoms (e.g., a methoxycarbonyl group, an ethoxycarbonyl group, and a benzyloxycarbonyl group), an alkoxy group having up to 8 carbon atoms (e.g., a methoxy group, an ethoxy group, a butyloxy group, a benzyloxy group, and a phenethyloxy group), an aryloxy group having up to 8 carbon atoms (e.g., a phenoxy group, and a p-tolyloxy group), an acyloxy group having up to 8 carbon atoms (e.g., an acetyloxy group, a propionyloxy group, and a benzoyloxy group), an acyl group having up to 8 carbon atoms (e.g., an acetyl group, a propionyl group, a benzoyl group, and a 4-fluorobenzoyl group), a carbamoyl group having up to 6 carbon atoms (e.g., a carbamoyl group, an N,N-dimethylcarbamoyl group, a morpholinocarbonyl group, and a piperidinocarbonyl group), a sulfamoyl group having up to 6 carbon atoms (e.g., a sulfamoyl group, an N,N-dimethylsulfamoyl group, a morpholinosulfonyl group, and a piperidinosulfonyl group), or an aryl group having up to 10 carbon atoms (e.g., a phenyl group, a p-fluorophenyl group, a p-hydroxyphenyl group, a p-carboxyphenyl group, and a p-sulfophenyl group).

The anion represented by X included an organic or inorganic acid anion such as a chloride ion, a bromide ion, an iodide ion, a p-toluene sulfonate ion, a p-nitrobenzene sulfonate ion, a methane sulfonate ion, a methylsulfate ion, an ethylsulfate ion, a 1,3-naphthalene disulfonate ion, a perchlorate ion, etc.

Typical examples of the compounds represented by formula (I) used in the present invention are given below, but the present invention is not to be construed as being limited to these compounds.

1

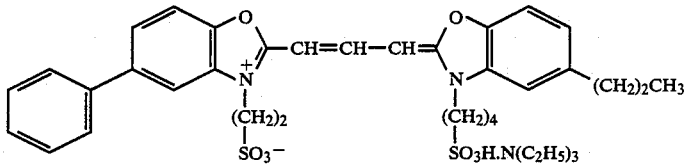

2

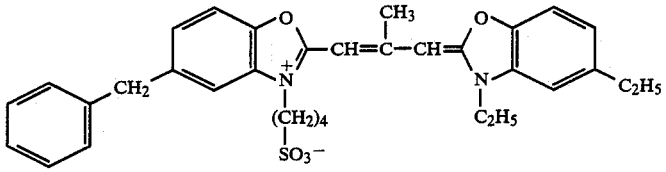

3

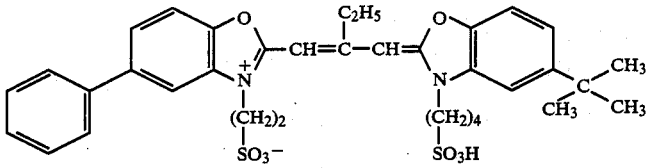

4

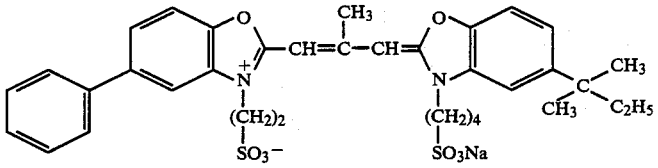

5

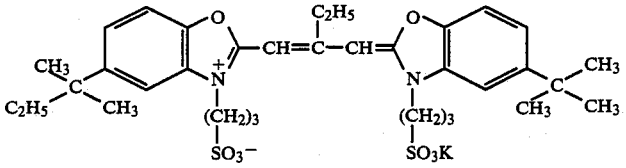

-continued
6
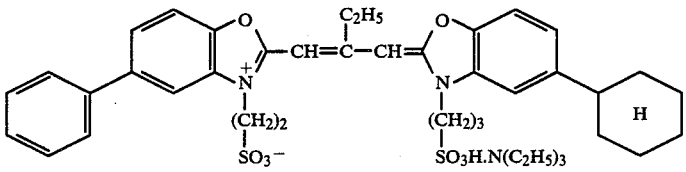
7
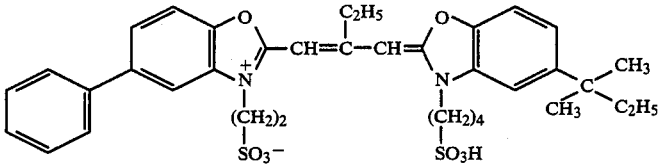
8
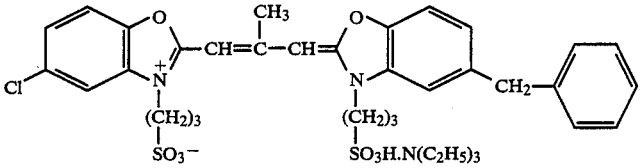
9
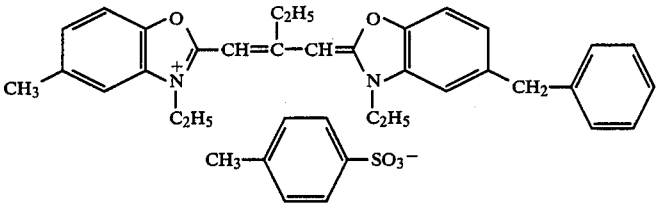
10
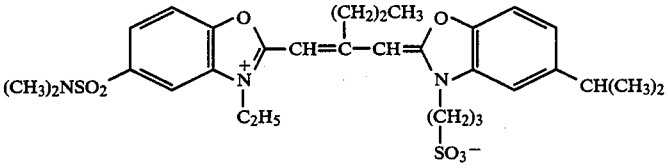
11
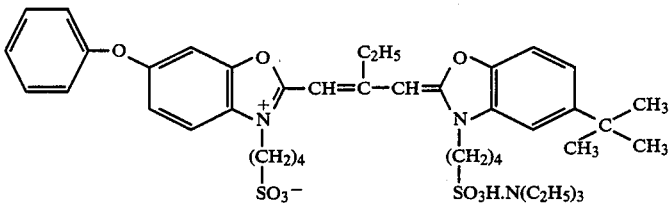
12
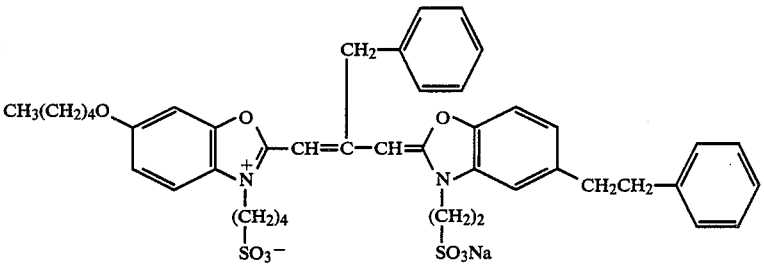
13
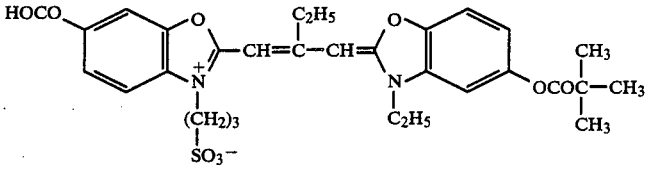

-continued

14

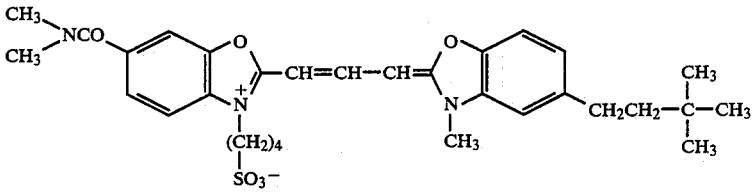

15

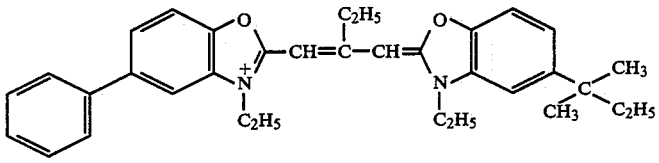

16

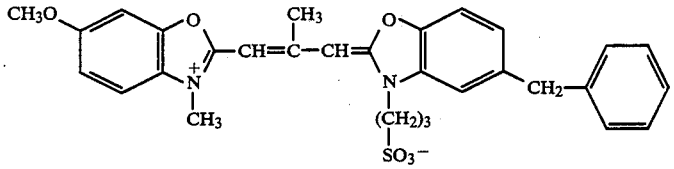

17

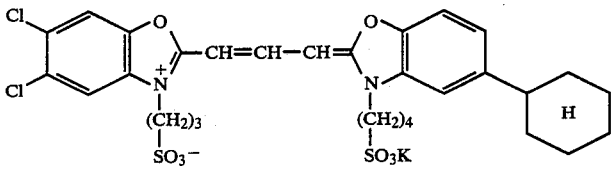

18

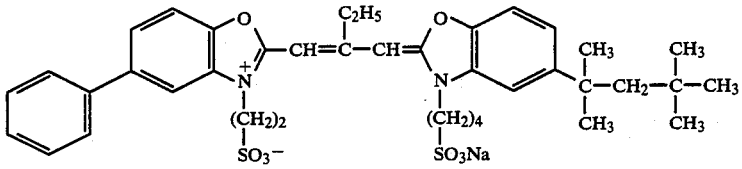

19

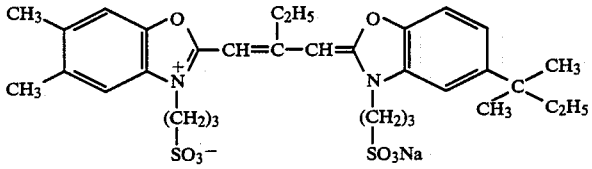

20

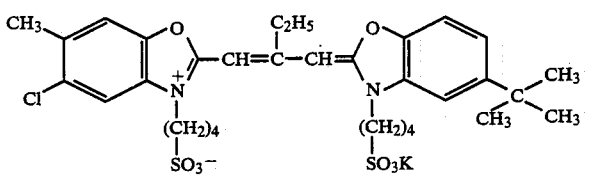

The compounds represented by formula (I) can be easily synthesized by methods described, for example, in *Heterocyclic Compounds, the Cyanine Dyes, and Relative Compounds,* by Heymer (John Wiley and Sons 1964).

In the present invention, when a light-sensitive silver halide is spectrally sensitized with at least one dye represented by formula (I), the storage stability of the light-sensitive material is improved.

By the use of the sensitizing dyes of the present invention, a high spectral sensitization in the green light range and good reciprocity law failure characteristics can be obtained. The sensitized color of the present invention has a spectral sensitivity distribution particularly suitable for the wavelength of a green light laser light source(i.e., from 500 to 550 nm). The sensitizing dyes of the present invention would not transfer to a dye fixing element, and they would not cause stain on the dye fixing element, thus are suitable for obtaining a clear transferred dye image.

The amount of the sensitizing dyes represented by formula (I) to be added is generally about from $10^{-8}$ to $10^{-2}$ mol per mol of silver halide, preferably about from $10^{-7}$ to $10^{-4}$ mol per mol of silver halide.

The sensitizing dyes used in the present invention can be dispersed directly in an emulsion. Alternatively, they are firstly dissolved in a suitable solvent such as methyl alcohol, ethyl alcohol, methyl cellosolve, acetone, water, pyridine or mixture of these, and then the solution can be added to an emulsion. Ultrasonic waves can be used to agitate the solution Methods for adding the sensitizing dyes include the method described, for example, in U.S. Pat. No. 3,469,987, in which the dye is dissolved in a volatile organic solvent, then the solution is dispersed in a hydrophilic colloid, and the dispersion is added to an emulsion; the method described, in Japanese Patent Publication No. 24185/71 in which the water-insoluble dye is dispersed in a water-soluble solvent without dissolving the dye and the dispersion is added to an emulsion; the method described in U.S. Pat. No. 3,822,135, in which the dye is dissolved in a surface active agent and the solution is added to an emulsion; the method described in Japanese Patent Application (OPI) No. 74624/76, in which the dye is dissolved in a compound capable of effecting a red shift, and the solution is added to an emulsion; and the method described in Japanese Patent Application (OPI) No. 80826/75, in which the dye is dissolved in an acid substantially free from water and the solution is added to an emulsion. Also, in order to add the dyes to emulsions, the methods described in U.S. Pat. Nos. 2,912,343, 3,342,605, 2,996,287, and 3,429,835, etc. can be used. Although the sensitizing dye may be uniformly dispersed in a silver halide emulsion before it is applied onto a suitable support, it may be dispersed in a silver halide emulsion in any of the stages of preparing the silver halide emulsion. For example, the sensitizing dye may present when silver halide grains are formed, or may be present during ripening. In the present invention, in addition to the dyes represented by formula (I), other sensitizing dyes may be used.

The present light-sensitive material may have, if required, in addition to the green-sensitive layer, at least one layer having a sensitivity to another spectral range. Specific examples of such a layer include a blue-sensitive layer, a red-sensitive layer, an infrared-sensitive layer, etc.

The silver halide used in the present invention may be any of silver chloride, silver bromide, silver iodide, silver chlorobromide, silver chloroiodide, silver bromoiodide, and silver bromochloroiodide. The halogen composition in the grains may be uniform, or the grains may have a multiple structure in which the composition in the surface is different from that of the inside, as disclosed in Japanese Patent Application (OPI) Nos. 154232/82, 108533/83, 48755/84, and 52237/84, U.S. Pat. No. 4,433,048 and European Patent 100,984. Also, tabular grains having a thickness of about 0.5 μm or less, a diameter of at least about 0.6 μm and an average aspect ratio of about 5 or more can be used, as disclosed in U.S. Pat Nos. 4,414,310 and 4,435,499, West German Patent Application (OLS) 3,241,644A1, etc. Monodisperse emulsions, in which the grain size distribution is almost uniform, as disclosed in Japanese Patent Application (OPI) Nos. 178235/82, 100846/83, and 14829/83, International Patent Publication No. 83/02338A1, European Patent Application Nos. 64,412A3 and 83,377A1, etc. can be used in the present invention. Two or more silver halides that are different, for example, in crystal habit, halogen composition, grain size, or grain size distribution may be used in combination. Two or more monodisperse emulsions different in grain size may be mixed to regulate the gradation.

Preferably, the grain size of silver halides used in the present invention is such that the average grain diameter is about from 0.001 to 10 μm, more preferably, about from 0.001 to 5 μm. The silver halide emulsions may be prepared by any of an acid process, a neutral process, and an ammonia process, and the soluble silver salt and soluble halide may be reacted by a single jet method, a double jet method or a combination of them. The reverse jet method, in which grains are formed with silver ions present in an excess amount, or the controlled double jet method, in which the pAg is kept constant can also be used. To quicken the growth of the grains, the amount of the solutions added, the rate of addition or the concentration of the solutions of the silver salt and the halide may be increased, as described, for example, in Japanese Patent Application (OPI) Nos. 142329/80 and 158124/80, and U.S. Pat. No. 3,650,757.

Epitaxially joined silver halide grains may also be used, as disclosed in Japanese Patent Application (OPI) No. 16124/81 and U.S. Pat. No. 4,094,684.

In the step of forming silver halide grains used in the present invention, a silver halide solvent can be used, such as ammonia, the organic thioether derivatives described in Japanese Patent Publication No. 11386/72, or sulfur-containing compounds described in Japanese Patent Application (OPI) No. 144319/78.

In the process of the formation or physical ripening of grains, cadmium salts, zinc salts, lead salts, thallium salts or the like may also be present. When the silver halide is prepared, the additives disclosed in Research Disclosure 19227 (1980) may be added.

For the Purpose of improving the high intensity reciprocity law failure and the low intensity reciprocity law failure, water-soluble iridium salts such as iridium (III, IV) chlorides, ammonium hexachloroiridiate or water-soluble rhodium salts such as rhodium chloride can be used.

Further, the silver halide emulsions described in Japanese Patent Application No. 225176/85, and the silver halide emulsions described in Japanese Patent Application No. 228267/85 are also preferred.

Soluble salts may be removed from the silver halide emulsion after the formation of the grains or after their physical ripening, and for that purpose, the noodle washing method or the sedimentation method can be used.

The silver halide emulsion may be used without ripening, but generally it is used after it is chemically sensitized. Any of sulfur sensitization, reduction sensitization, noble metal sensitization, etc. which are conventionally used for emulsions of light-sensitive materials may be used alone or in combination. The chemical sensitization can be carried out in the presence of a nitrogen-containing heterocyclic compound, as described in Japanese Patent Application (OPI) Nos. 126526/83 and 215644/83.

The silver halide emulsion used in the present invention may be of a surface latent image type in which a latent image is mainly formed on the grain surfaces, or of an internal latent image type in which a latent image is formed in the interior of the grains. A direct reversal emulsion in which an internal latent image type emulsion and a nucleating agent are combined can be used. Internal latent image type emulsions suitable for such a purpose are described, for example, in U.S. Pat. Nos. 2,592,250, and 3,761,276, Japanese Patent Publication No. 3524/83, and Japanese Patent Application (OPI) No. 136641/82. Nucleating agents which may be preferably used in the present invention are described, for example, in U.S. Pat. Nos. 3,227,552, 4,245,037, 4,255,511, 4,266,031, and 4,276,364, and West German Patent Application (OLS) No. 2,635,316.

The coating amount of the light-sensitive silver halide used in the present invention is preferably in the range of about from 1 mg/m$^2$ to 10 g/m$^2$ in terms of silver.

In the present invention, together with the light-sensitive silver halide, an organic metal salt can be used as an oxidizing agent. In this case, the light-sensitive silver halide and the organic metal salt are required to be in contact or the distance between them must be small.

Of such organic metal salts, an organic silver salt is particularly preferably used. Organic compounds which can be used for forming the above organic silver salt oxidizing agents include the compounds described, for example, in Japanese Patent Application (OPI) No. 47420/86 and U.S. Pat. No. 4,500,626, columns 52 to 53. Silver salts of carboxylic acids having an alkynyl group such as silver phenylpropiolate and acetylene silvers described in Japanese Patent Application No. 249044/86 are also useful. Two or more organic silver salts may be used in combination.

The organic silver salts can be generally used in an amount of about from 0.01 to 10 mols, preferably about from 0.01 to 1 mol, per mol of the light-sensitive silver halide. It is preferred that the total coating amount of the light-sensitive silver halide and the organic silver salt be about from 50 mg/m$^2$ to 10 g/m$^2$ in terms of silver.

In the present invention, silver can be used as an image forming material. A compound which can produce or release a mobile dye corresponding to or counter corresponding to the silver reaction when silver ions are reduced to silver under high temperature conditions, i.e., a dye providing substance, can also be used as an image-forming substance.

Examples of dye providing substances which can be used in the present invention include compounds which can form a dye by an oxidation coupling reaction(couplers). The couplers may be 4-equivalent couplers or 2-equivalent couplers. The 2-equivalent couplers having a ballast group, in a coupling-off group capable of forming a diffusible dye by an oxidation and coupling reaction are preferred. Specific examples of developers and couplers are described in detail, for example, in T. H. James, *The Theory of the Photographic Process,* pages 291 to 334 and 354 to 361, and Japanese Patent Application (OPI) Nos. 123533/83, 149046/83, 149047/83, 111148/84, 124399/84, 174835/84, 231539/84, 231540/84, 2950/85, 2951/85, 14242/85, 23474/85, and 66249/85.

Particularly preferred examples of other dye providing substances include compounds capable of releasing or diffusing a diffusible dye imagewise. This type of compound can be represented by formula (LI):

$$(\text{Dye-X})n—Y \qquad \text{(LI)}$$

wherein Dye represents a dye moiety, a dye moiety in which the adsorption wavelength is temporarily shifted to the short wavelength region, or a dye precursor group; X represents a bond or a linking group; Y represents a group which alters the diffusibility of the compound represented by formula (LI) corresponding to or counter corresponding to a light-sensitive silver salt having a latent image or a group which releases Dye and provides a different in diffusibility between the released Dye and (Dye-X)n—Y; n is 1 or 2; and when n is 2, the two Dye-X moieties may be the same or different.

Typical examples of dye providing substances represented by formula (LI) are dye developers formed by connecting hydroguinone type developers and dye components that are described, for example, in U.S. Pat. Nos. 3,134,764, 3,362,819, 3,597,200, 3,544,545, and 3,482,972. Materials which can release diffusible dyes by an intramolecular nucleophilic substitution reaction are described, for example, in U.S. Pat. No. 3,980,479, and materials that can release diffusible dyes by an intramolecular rewinding reaction of an isooxazolone ring are described, for example, in Japanese Patent Application (OPI) No. 111628/74.

A system can also be used in which a dye releasing compound is converted into an oxidized form having no ability to release a dye, and it is present together with a reducing agent or its precursor, and after the development, it is reduced by the reducing agent that has remained without being oxidized, thereby releasing a diffusible dye. Specific examples of dye providing substances used therein are described in Japanese Patent Application (OPI) Nos. 110827/78, 130927/79, 164342/81, and 35533/78. In Japanese Patent Application No. 88625/86, as dye providing substances that can release a diffusible dye by a similar mechanism are disclosed compounds in which an N—O bond is cleaved by the remaining reducing agent to release a diffusible dye.

Non-diffusible compounds (LDA compounds) described in Japanese Patent Application (OPI) No. 185333/84 that can undergo a donor-acceptor reaction in the presence of a base to release a diffusible dye, but that substantially do not release a dye when they react with the oxidized product of a reducing agent can also be used.

All of these methods are methods in which a diffusible dye is released or diffused in an image area where development has not taken place, and the dye is neither released nor diffused in an image area where development has taken place.

On the other hand, materials that can release diffusible dyes in an image area where development has taken place, include materials (DDR couplers) having a diffusible dye in a coupling-off group that can release the diffusible dye by a reaction with the oxidation product of a reducing agent, as described, for example, in British Patent No. 1,330,524, Japanese Patent Publication No. 39165/73, and British Patent No. 3,442,940, can be used preferably in the present invention.

Since the staining of an image due to oxidized and decomposed products of a reducing agent in the above methods using reducing agents presents a serious problem, dye releasable compounds (DRR compounds) that do not require a reducing agent but have a reducibility themselves have also been suggested to overcome this problem, and can be used advantageously in the present invention. Typical examples of such compounds are dye providing substances described, for example, in U.S. Pat. Nos. 3,928,312, 4,053,312, 4,055,428, and 4,336,322, Japanese Patent Application (OPI) Nos. 65839/84, 69839/84, 3819/78, and 104343/76, Research Disclosure No. 17465, U.S. Pat. Nos. 3,725,062, 3,728,113, and 3,443,939, Japanese Patent Application (OPI) Nos. 116537/83, and 179840/82, and U.S. Pat. No. 4,500,626. Specific examples of these dye providing substances are compounds described in U.S. Pat. No. 4,500,626, columns 22 to 44, with compounds (1) to (3), (10) to (13), (16) to (19), (28) to (30), (33) to (35), (38) to (40) and (42) to (64) being preferred. The compounds described in Japanese Patent Application (OPI) No. 124941/86, pages 21 to 23 are also useful. As dye providing substances other than the above-mentioned compounds, can be used dye silver compounds in which an organic silver salt combines with a dye (Research Disclosure, (May 1978), pages 54 to 58, etc.), azo dyes used in the heat developable silver-dye bleaching method (U.S. Pat. No. 4,235,957, Research Disclosure, (April 1976), pages 30 to 32, etc.), and leuco dyes (U.S. Pat. Nos. 3,985,565, and 4,022,617).

The above dye providing compounds and hydrophilic additives including image formation accelerating agents mentioned below can be introduced into layers of the light-sensitive material in any conventional manner, such as that described, for example, in U.S. Pat. No. 2,322,027. In this case, a high-boiling organic solvent as described, for example, in Japanese Patent Application (OPI) Nos. 83154/84, 178451/84, 178452/84, 178453/84, 178454/84, 178455/84, and 178457/84 can be used in combination with a low-boiling organic solvent having a boiling point of about from 50° to 160° C., if necessary.

The amount of a high-boiling organic solvent to be used is up to about 10 g, preferably up to about 5 g, per 1 g of the dye providing substance.

The dispersing methods using a polymer described in Japanese Patent Publication No. 39853/76 and Japanese Patent Application (OPI) No. 59943/76 can also be used.

If the compound is substantially insoluble in water, the compound can be dispersed in the form of finely divided particles in a binder.

When a hydrophobic material is dispersed in a hydrophilic colloid, various surface active agents can be used.

For example, the surface active agents mentioned in Japanese Patent Application (OPI) No. 157636/84, pages 37 to 38, can be used.

In the present invention, it is desirable that a reducing substance is contained in the light-sensitive material. Reducing substances include, in addition to generally known reducing agents, the above dye providing substances having a reducing ability. Also, reducing agent precursors which do not have reducing ability by themselves, but which acquire a reducing ability by the action of a nucleophilic agent or heat during development can be included.

Examples of the reducing agents which can be used in the present invention include reducing agents described, for example, in U.S. Pat. Nos. 4,500,626 (columns 49 to 50), and 4,483,914 (columns 30 to 31), and Japanese Patent Application (OPI) Nos. 140335/85 (pages 17 to 18), 128438/85, 128436/85, 128439/85, and 128437/85. Reducing agent precursors described, for example, in Japanese Patent Application (OPI) Nos. 138736/81, and 40245/82, and U.S. Pat. No. 4,330,617 can also be used. Combinations of various reducing agents as disclosed in U.S. Pat. No. 3,039,869 can also be used.

In the present invention, the amount of the reducing agent to be added is about from 0.01 to 20 mols, more preferably about from 0.1 to 10 mols, per mol of silver.

In the present invention, compounds which can activate development and at the same time can stabilize the image can be used in the light-sensitive material. Specific compounds which can preferably be used are described in U.S. Pat. No. 4,500,626, columns 51 to 52.

In the present invention, various antifoggants or photographic stabilizers can be used, and examples thereof are azoles and azaindenes described in Research Disclosure (December 1978), pages 24 to 25; phosphoric acids and carboxylic acids containing nitrogen described in Japanese Patent Application (OPI) No. 168442/84; mercapto compounds and their metal salts described in Japanese Patent Application (OPI) No. 111636/84; and acetylene compounds described in Japanese Patent Application No. 228267/85.

In the present invention, the light-sensitive material, if desired, can contain an image toning agent. Specific examples of effective toning agents are compounds described in Japanese Patent Application (OPI) No. 147244/86, page 24.

To obtain a color in a wide range using three primary colors, that is, yellow, magenta and cyan in the chromaticity diagram, it is only required to use a light-sensitive material having at least three silver halide emulsion layers sensitive to different spectral ranges. For example, the combination of a blue sensitive layer, a green sensitive layer and a red sensitive layer and the combination of a green sensitive layer, a red sensitive layer and an infrared sensitive layer are typically used. If desired, each of these photosensitive layers may be divided into two or more layers.

The light-sensitive material according to the present invention, if desired, can have, for example, a protective layer, an intermediate layer, an antistatic layer, an antihalation layer, a releasing layer for facilitating release from a dye fixing material, and a matting layer, in addition to light-sensitive layers and various conventional additives known for heat developable light-sensitive materials. The various additives include, for example, discoloration preventive agents, anti-oxidizing agents, antislipping agents, brightening agents, surface active agents, antihalation agents, sharpness improving dyes, matting agents, and plasticizers described, for example, in Research Disclosure (June 1978), pages 9 to 15, and Japanese Patent Application (OPI) No. 88256/86. Particularly, it is typical for a protective layer to contain an organic or inorganic matting agent for preventing adhesion. A protective layer may also contain a mordant and an ultraviolet absorber. A protective layer and an intermediate layer each may consist of two or more layers.

An intermediate layer may contain a white pigment such as titanium dioxide, an ultraviolet absorber, or a reducing agent for preventing colors from mixing or for preventing fading. A white pigment may be added not only to an intermediate layer but also to an emulsion layer for improving its sensitivity.

The photographic material according to the present invention is made up of a light-sensitive material that can form or release a dye by heat development, and, if desired, a dye fixing material for fixing the dye.

Particularly, in a system wherein an image is formed by the diffusion transfer of a dye, a light-sensitive material and a dye fixing material are essential. The light-sensitive material and dye fixing material can be applied separately on two supports, or the light-sensitive material and dye fixing material can be applied on the same support. The relationship between a light-sensitive material and a dye fixing material; the relationship between a light-sensitive material and a base; and the relationship between a light-sensitive material and a white reflective layer are described in Japanese Patent Application (OPI) No. 147244/86, page 15, and U.S. Pat. No. 4,500,626, column 57.

Dye fixing materials preferably used in the present invention have at least one layer containing a mordant and a binder. Any mordants known in the field of photography can be used, and specific examples thereof include those described in Japanese Patent Application (OPI) No. 88256/86, pages 32 to 41. A dye fixing material, if desired, can have an auxiliary layer such as a protective layer, a releasing layer, and a curling preventive layer. It is particularly useful to provide a protective layer.

One or more layers of the above layers may contain a hydrophilic heat solvent, a plasticizer, an anti-discoloration agent, an ultraviolet absorber, a slipping agent, a matting agent, an anti-oxidizing agent, a dispersed vinyl compound for increasing dimensional stability, a surface active agent, a fluorescent whitening agent, etc. In a system in which heat development and transfer are simultaneously carried out in the presence of a small amount of water, it is preferred that the dye fixing material contain a base and/or a base precursor described below from the point of view of increasing the storability of the light-sensitive material Specific examples of these additives are described in Japanese Patent Application (OPI) No. 88256/86, pages 24 to 32.

In the present invention, an image formation accelerating agent can be used in the light-sensitive material and/or the dye fixing material. Image formation accelerating agents have functions, for example, of accelerating the oxidation-reduction reaction between a silver salt oxidizing agent and a reducing agent, of accelerating the formation of a dye from a dye providing substance or the decomposition of the dye or the reaction of release of a diffusible dye, and of facilitating the transfer of a dye from a light-sensitive material layer to a dye fixing layer, and can be classified by physicochemical function into bases or base precursors, nucleophilic couplers, high-boiling organic solvents (oils), heat solvents, surface active agents, compounds which will have interactions with silver or silver ions. Generally these compounds, however, have a composite function and usually perform combination of the above accelerating effects. Details of these agents are described in Japanese Patent Application (OPI) No. 93451/86, pages 67 to 71.

There are various additional methods of generating a base, and any compounds used in the methods are useful as base precursors in the present invention, including the a method described in Japanese Patent Application No. 169585/85 wherein a sparingly soluble metal compound and a complex forming compound (capable of reacting with the metal ion constituting the sparingly soluble metal compound to form a complex) are mixed to generate a base; and the method described in Japanese Patent Application (OPI) No. 232451/86, in which a base is generated by electrolysis.

The former method is particularly effective. Sparingly soluble compounds include carbonates, hydroxides, oxides, etc. of zinc, aluminium, calcium, barium, etc. Complex forming compounds are described by A. E. Martell, and R. M. Smith, in *Critical Stability Constants,* Vol. IV and V, (Plenum Press). Specific examples of complex forming compounds are salts of alkali metals, guanidines, amidines or quaternary ammonium compounds with aminocarboxylic acids, imidino acetic acids, pyridylcarboxylic acids, aminophosphoric acids, carboxylic acids (mono-, di-, and tetra-carboxylic acids and compounds having a substituent such as a phosphono group, a hydroxyl group, an oxo group, an ester, an amide, an alkoxy group, a mercapto group, an alkylthio group, and a phosphino group), hydroxamic acids, polyacrylates, and polyphosphoric acids, etc.

It is advantageous that the sparingly soluble metal compound and the complex forming compound be added separately to a light-sensitive material and a dye fixing material.

The present light-sensitive material and/or dye fixing material can contain various development stopping agents to obtain consistent image quality at all times despite changes in development time and processing temperature at the time of development.

Herein the term "development stopping agents" means compounds that can neutralize or react with a base quickly after proper development thereby reducing the concentration of the base in the film to stop the development, or compounds that can interact with silver and silver salts to suppress the development. Specific examples of the development stoppers are acid precursors capable of releasing an acid when heated, electrophilic compounds capable of undergoing a substitution reaction with a base present when heated, or nitrogen-containing heterocyclic compounds of mercapto compounds and their precursors (e.g., the compounds described in Japanese Patent Application (OPI) Nos. 108837/85, 192939/85, 230133/85, and 230134/85).

Compounds that can release a mercapto compound when heated are also useful, and examples of such compounds are described, for example, in Japanese Patent Application (OPI) Nos. 67851/86, 147244/86, 124941/86, 185743/86, 182039/86, 185744/86, 184539/86, 188540/86, and 53632/86.

As a binder for the light-sensitive material and/or dye fixing material used in the present invention, a hydrophilic binder can be used. Typical hydrophilic binders are transparent or semitransparent hydrophilic binders such as proteins including gelatin and gelatin derivatives; cellulose derivatives; natural substances such as polysaccharides including acacia, and starches; and synthetic polymeric materials including water-soluble polyvinyl compounds including acrylamide polymers, and polyvinyl pyrrolidones. Dispersed vinyl compounds used in the form of a latex can be used to increase the dimensional stability of the photographic material. These binders may be used alone or in combination.

In the present invention, it is preferred that the coating amount of the binder is up to about 20 g, preferably up to about 10 g, and more preferably up to about 7 g, per 1 $m^2$ of the light-sensitive material.

The ratio of a high-boiling organic solvent to the binder (when the high-boiling organic solvent is dispersed together with a hydrophobic compound such as a dye providing substance into the binder), is such that generally up to about 1 cc of the solvent, preferably up to about 0.5 cc of the solvent, and more preferably up to about 0.3 cc of the solvent, is used per 1 g of the binder.

The structural layers (including a photographic emulsion layer, a dye fixing layer, etc.) of the light-sensitive material and/or dye fixing material according to the present invention may contain an inorganic or organic hardening agent. Specific examples of hardening agents are hardening agents described in Japanese Patent Application (OPI) Nos. 147244/86, pages 24 to 25; and 157636/84, page 38, which can be used alone or in combination.

To facilitate the transfer of the dye, a hydrophilic heat solvent that is solid at normal temperature but can be melted at high temperature can be contained in the light-sensitive material or the dye fixing material.

The hydrophilic heat solvent may be contained in either or both of the light-sensitive material and the dye fixing material. The layer that can contain the hydrophilic heat solvent may be any one of an emulsion layer, an intermediate layer, a protective layer, and a dye fixing layer, with a dye fixing layer and/or a layer adjacent thereto preferred. Examples of hydrophilic heat solvents are ureas, pyridines, amides, sulfonamides, imides, alneals, oximes, and other heterocyclic ring compounds. Further, to facilitate the transfer of the dye, a high-boiling organic solvent may be contained in the light-sensitive material and/or the dye fixing material.

The support used for the light-sensitive material and/or dye fixing material according to the present invention can be any conventional support which can withstand the processing temperature. Generally, a glass base, a paper base, a polymer film, a metal base and the like, as well as supports described in Japanese Patent Application (OPI) No. 147244/86, page 25.

The light-sensitive material and/or dye fixing material may contain a conductive heat generating body layer to provide heat for diffusion transfer of the dye or heat development.

In this case, the transparent or opaque heat generating element can be made as a resistance heat generating body using a known technique, such as a method using a thin film of an inorganic semiconductor material and a method using an organic thin film containing conductive fine particles dispersed in a binder. Materials which can be used in these methods are those described in Japanese Patent Application (OPI) No. 29835/86.

In the present invention, any conventional methods of applying a heat developable light-sensitive layer, a protective layer, an intermediate layer, an undercoat layer, a back layer, a dye fixing layer and other layers can be used, including the methods described in U.S. Pat. No. 4,500,626, columns 55 to 56.

As a light source for imagewise exposure for recording an image to the light-sensitive material, radiation including visible light can be used without particular limitation. Generally, the following light sources can be used: a light source used for usual color prints, such as a tungsten lamp, a mercury-arc lamp, a halogen lamp such as a iodine lamp, a xenon lamp, a laser light source such as a Kr ion laser (530 nm), an argon ion laser (515 nm), a copper vapor laser (510 nm), a nitrogen fluoride chemical laser (529 nm), a He-Se laser (523 nm and 518 nm), a He-Cd laser (534 nm), a He-Ne laser (544 nm), a second higher harmonic of a Nd-YAG laser (532 nm), a second higher harmonic (about 525 nm) of a semiconductor laser (about 1.05$\mu$), and a dye laser using a coumarin dye (about 500 to 550 nm), a CRT light source, a light emission diode (LED), and light sources described in Japanese Patent Application (OPI) No. 147244/86, page 26, and U.S. Pat. No. 4,500,626.

The light-sensitive material of the present invention can be processed by a method for forming an image which comprises heat-developing the light-sensitive material of the present invention after or simultaneously with imagewise exposure thereof.

In the present invention, the step of heat development and the step of transfer of the dye may be independent or may be simultaneously carried out, or they may be continuous in that development is followed by transfer in one step.

For example, the light-sensitive material is imagewise exposed and is heated, and then a dye fixing material is placed thereon, if desired, in the presence of a very small amount of water.

Generally, the heating temperature in the heat development step is about from 50° to 250° C. to accomplish development, and particularly it is useful that the heating temperature in the heat development step is about from 80° to 180° C. If heating is carried out in the presence of a very small amount of water, the upper limit of the heating temperature is up to the boiling point of water. When the transfer step is carried out after the completion of the heat development step, it is possible to carry out the transfer with the heating temperature in the transfer step in the range of from the temperature in the heat development step to room temperature, and more preferably the transfer is carried out at a temperature of from about 50° C. to a temperature about 10° C. lower than the temperature in the heat development step.

In the present invention, in a preferred image forming method either after or during imagewise exposure of the light-sensitive material, it is heated in the presence of a very small amount of water and a base and/or a base precursor, and the diffusible dye produced in an area corresponding to or counter-correspondingly to the silver image is transferred to the dye fixing layer simultaneously with development. According to this method, since the formation or release reaction of the diffusible dye proceeds quite rapidly, and the transfer of the diffusible dye to the dye fixing layer proceeds quickly, a color image with a high density can be obtained in a short period of time.

The amount of water to be used in this system may be as small as at least 0.1 time, preferably 0.1 or more time the total coated weight of the light-sensitive element and the dye fixing element to the weight of the solvent in a volume equivalent to the maximum swollen volume of the coat film (particularly, less than the value obtained by subtracting the weight of the coat film from the weight of the solvent in a volume equivalent to the maximum swollen volume of the coat film).

Since the film is unstable when swollen, it can show local stain under some conditions. In order to avoid such a problem, the amount of water to be used is preferably less than the volume equivalent to the maximum swollen volume of the coat film of light-sensitive element dye fixing element. Particularly, it is preferably from 1 to 50 g, more preferably from 2 to 35 g, particularly preferably from 3 to 25 g per 1 $m^2$ of the total area of the light-sensitive element and the dye fixing element.

The base and/or base precursor used can be contained in the light-sensitive material and the dye fixing material, and can be supplied by dissolving in water.

In the above mode, it is preferable that as a base precursor a basic metal compound sparingly soluble in water and a compound capable of a complex formation reaction with the metal ion constituting that sparingly soluble metal compound through the medium of water are contained in an image forming reaction system so that the pH of the system may be allowed to rise due to the reaction of these two compound when heated.

Herein, the term "image reaction system" means the layers where image formation occurs, including the layers of both the light-sensitive material and the dye fixing material. If there are two layers, either layer may be an image reaction system.

The sparingly soluble metal compound and the complex forming compound are required to be added to at least two separate layers so that the reaction between them may be prevented until development is carried out. For example, in the case of a monosheet light-sensitive material where a light-sensitive material and a dye fixing material are provided on the same support, it is preferred that they are added to separate layers with one or more layers interposed between the separate layers. In a more preferred form, a sparingly soluble metal compound and a complex forming compound are contained in respective layers that are provided on different supports. For example, it is preferred that a sparingly soluble metal compound is contained in a light-sensitive material and a complex forming compound is contained in a dye fixing material having a support different from that of the light-sensitive material. The complex forming compound may be supplied by dissolving it in water supplied for development and transfer. It is preferred that the sparingly soluble metal compound is contained in the form of a fine particle dispersion prepared according to the methods described, for example, in Japanese Patent Application (OPI) Nos. 174830/81 and 102733/78, and preferably its average particle size is up to about 50 μm, particularly preferable up to about 5 μm. The sparingly soluble metal compound may be added to any of the light-sensitive layer, the intermediate layer, the protective layer or the like of the light-sensitive material, and may be added to two or more layers.

Although the amount of the sparingly soluble metal compound or the complex forming compound to be added when they are contained in layers on a base is dependent on the particular compounds used, the particle size of the sparingly soluble meal compound, the complex formation reaction rate, etc., the amount is suitably up to about 50 wt %, preferably in the range of about from 0.01 to 40 wt %, of the total weight of the coating film. When the complex forming compound is supplied by dissolving it in water, preferably the concentration is about from 0.005 to 5 mol, more preferably about from 0.05 to 2 mol, per liter. In the present invention, it is preferred that the molar content of the complex forming compound in the image reaction system is about from 1/100 times to 100 times, particularly about from 1/10 times to 20 times, the molar content of the sparingly soluble metal compound.

An example of a suitable method of applying water to the light-sensitive layer or the dye fixing layer is described in Japanese Patent Application (OPI) No. 147244/86, page 26.

The heating means used in the development step and/or the transfer step, is not particularly limited, and includes a hot plate, an iron and a heated roller described in Japanese Patent Application (OPI) No. 147244/86, pages 26 to 27. It is also possible to provide a layer of a conductive material such as graphite, carbon black and metals on the light-sensitive material and/or the dye fixing material, and to pass an electric current through the conductive layer to heat them directly.

A method in which the light-sensitive material and the dye fixing material are placed together and a pressure is applied is described in Japanese Patent Application (OPI) No. 147244/86, page 27.

To process the present photographic material, any of various heat development apparatuses can be employed. For example, those described in Japanese Patent Application (OPI) Nos. 75247/84, 177547/84, 181353/84, and 18951/85, and Japanese Utility Model Application No. 116734/85 can be used.

According to the invention, since the heat developable light-sensitive material contains a silver halide spectrally sensitized with at least one dye represented by formula (I), the heat developable light-sensitive material has high stability, permitting a prescribed sensitivity to be maintained even if it is stored for a long period of time.

Further, the heat developable light-sensitive material of the present invention is excellent in reciprocity law failure characteristics.

The prevent invention is now illustrated in greater detail with reference to specific embodiments thereof, but the prevent invention is not to be construed as being limited thereto. Unless otherwise indicated, all parts, percents and ratios are by weight.

EXAMPLE 1

A silver benzotriazole emulsion was prepared as follows.

28 g of gelatin and 13.2 g of benzotriazole were dissolved in 300 ml of water. The solution was stirred with the temperature kept at 40° C. A solution of 17 g of silver nitride in 100 ml of water was added to the solution over a period of 2 min.

The pH of the silver benzotriazole emulsion was adjusted to take place sedimentation thereby the excess salt was removed. Thereafter, the pH was adjusted to 8.30, to obtain 400 g of the silver benzotriazole emulsion.

Silver bromoiodide emulsion (A) was prepared as follows.

Liquid I and liquid II given below were added simultaneously over a period of 20 min at the same flow rate to a well stirred aqueous gelatin solution (that was obtained by dissolving 20 g of gelatin, 0.75 g of KBr and 0.38 g of $HO(CH_2)_2S(CH_2)_2S(CH_2)_2OH$ in 600 ml of water and was kept at 68° C.). After allowing the mixture to stand for 10 min, liquid III and liquid IV given below were added over a period of 30 min by the controlled double jet method with the pAg kept at 8.4. After washing with water and desalting, 25 g of gelatin and 100 ml of water were added, and the pH and the pAg were adjusted to 6.4 and 8.4, respectively.

| | I (160 ml in all) | II (160 ml in all) | III (450 ml in all) | IV (450 ml in all) |
|---|---|---|---|---|
| $AgNO_3$ | 20 g | — | 80 g | — |
| KBr | — | 14 g | — | 62 g |
| KI | — | 1 g | — | — |

The emulsion obtained was a monodisperse octahedral silver bromoiodide emulsion having a grain size of about 0.55 μm.

The emulsion obtained was then chemically sensitized optimally with sodium thiosulfate at 60° C. The yield was 650 g.

A gelatin dispersion of a dye providing substance was prepared as follows.

5 g of yellow dye providing substance (a) and 10 g of tricresyl phosphate were weighed and added to 30 ml of ethyl acetate and the mixture was heated to about 60° C. to obtain a uniform solution. 10 g of the thus prepared 3% aqueous gelatin solution, and 60 mg of an aqueous 2.5% sodium dodecylbenzensulfonate solution were mixed and stirred, and were dispersed by a homogenizer for 10 min at 10,000 rpm. The dispersion is referred to herein as a dispersion of the yellow dye providing substance.

Yellow Dye Providing Substance (a)

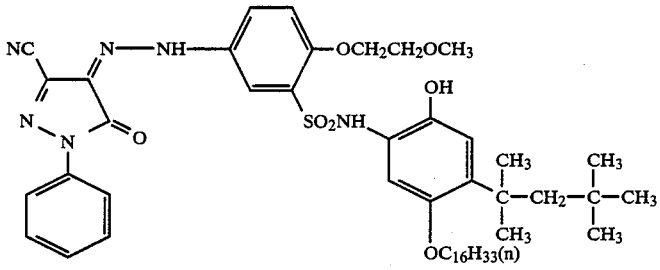

A light-sensitive coating solution was prepared as follows:

| | | |
|---|---|---|
| (a) | silver benzotriazole emulsion | 7 g |
| (b) | light-sensitive silver bromoiodide emulsion (A) | 8 g |
| (c) | dispersion of the yellow dye providing substance | 25 g |
| (d) | aqueous 5% solution of the following compound: | 5 ml |

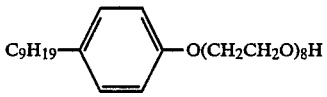

| | | |
|---|---|---|
| (e) | 10% methanol solution of benzenesulfonamide | 5 ml |
| (f) | aqueous 10% solution of 4-methylsulfonylphenylsulfonylacetic acid guanidine | 15 ml |
| (g) | 0.04% methanol solution of sensitizing dye Compound (2) described hereinbelow | 5 ml |

The above-mentioned ingredients were mixed, and a thickening agent and water were added thereto to make the solution to 100 ml. The solution was applied on a polyethylene terephthalate film having a thickness of 180 m to a wet thickness of 50 μm.

A protective layer coating composition was prepared as follows.

| | | |
|---|---|---|
| (h) | 10% gelatin solution | 400 g |
| (i) | aqueous 10% solution of 4-methylsulfonylphenylsulfonylacetic acid guanidine | 240 ml |
| (j) | aqueous 4% solution of a hardening agent having the following structure: | 50 ml |

-continued $CH_2{=}CH{-}SO_2CH_2CONH{-}(CH_2)_2{-}NHCOCH_2SO_2CH{=}CH_2$

The above-mentioned ingredients ere mixed, and a thickening agent and water were added thereto to bring the composition to 100 ml.

The protective layer composition was applied on the above light-sensitive coating to a wet thickness of 30 μm followed by drying to produce light-sensitive material 1.

Light-sensitive materials 2 to 5 were prepared in the same manner as in the preparation of light-sensitive material 1, except that the sensitizing dyes of light-sensitive material 1 were changed to the sensitizing dyes shown in Table I.

Thus-prepared light-sensitive materials were exposed imagewise to light at 5,000 luxes for 1 sec by using a tungsten lamp with a SC-50 filter manufactured by Fuji Photo Film Co., Ltd.

Thereafter, they were heated uniformly for 30 sec on a heat block heated to 140° C.

A dye fixing material was prepared as follows.

10 g of poly(methyl acrylate-co-N,N,N-trimethylvinylbenzylammonium chloride) (copolymerization ratio of methyl acrylate to vinylbenzylammonium chloride: 1:1) were dissolved in 200 ml of water, and then were mixed uniformly with 100 g of 10% lime-processed gelatin solution. The solution mixture was applied uniformly on a paper base laminated with polyethylene in which titanium dioxide was dispersed to a wet thickness of 90 μm. After the coated layer was dried, it was used as a dye fixing material having a mordant layer.

After 20 ml of water per 1 $m^2$ was applied to the above-coated mordant layer of the dye fixing material, each of the light-sensitive materials which had been heat-treated and the fixing material with the protective layer and mordant layer in contact.

After heating each of the laminated samples for 6 sec on a heat block at 80° C., the dye fixing material was removed from the light-sensitive material, and a yellow image was produced on the fixing material. The density of the image was measured using a Macbeth reflection type densitometer (RD519).

In another test, after another light-sensitive materials were stored for 50° C. for 3 days, it was exposed and processed in the same manner as above.

The results are given in Table I.

TABLE I

| Light-Sensitive Material | Sensitizing Dye | Immediately after Preparation | | After stored at 50° C. for 3 days | | Note |
|---|---|---|---|---|---|---|
| | | Fogging | Sensitivity*1 | Fogging | Sensitivity*1 | |
| 1 | (2) | 0.20 | 1.0 | 0.29 | 0.95 | Invention |
| 2 | (7) | 0.21 | 0.85 | 0.32 | 0.75 | Invention |

TABLE I-continued

| Light-Sensitive Material | Sensitizing Dye | Immediately after Preparation Fogging | Immediately after Preparation Sensitivity*1 | After stored at 50° C. for 3 days Fogging | After stored at 50° C. for 3 days Sensitivity*1 | Note |
|---|---|---|---|---|---|---|
| 3 | (9) | 0.16 | 0.90 | 0.29 | 0.80 | Invention |
| 4 | (16) | 0.22 | 0.95 | 0.31 | 0.80 | Invention |
| 5 | Comparative dye (a)*2 | 0.23 | 0.95 | 0.48 | 0.65 | Comparison |

*1The sensitivity is expressed in terms of a relative value, when the value of -log E (wherein E represents the exposure quantity) for light-sensitive material 1 immediately after preparation was designated as 1.0.
*2Comparative dye (a):

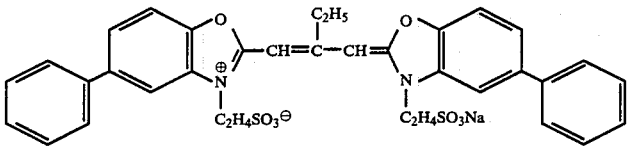

From results shown in Table I, it can be understood that when the sensitizing dye of the present invention was used, the decrease in sensitivity due to storage was small and the stability was high, even under extreme conditions of temperature and humidity.

Light-sensitive materials 1 to 5 immediately after coating were exposed to light for $10^{-4}$ sec by using a flash lamp sensitometer (manufactured by EGG company) with a SC-50 filter attached, and were processed in the same way. The change in sensitivity with the exposure time is given in Table II.

TABLE II

| Light-sensitive Material | Sensitizing Dye | Fogging | Sensitivity* (1 sec exposure) | Sensitivity* ($10^{-4}$ sec exposure) | Note |
|---|---|---|---|---|---|
| 1 | (2) | 0.20 | 1.0 | 1.0 | Invention |
| 2 | (7) | 0.21 | 0.85 | 0.8 | Invention |
| 3 | (9) | 0.16 | 0.90 | 0.85 | Invention |
| 4 | (16) | 0.22 | 0.95 | 0.95 | Invention |
| 5 | Comparative dye (a) | 0.23 | 0.95 | 0.70 | Comparison |

*The sensitivity is expressed in terms of a relative value, obtained by designating as 1 the value of −log E of the amount of light of 1 sec exposure and $10^{-4}$ sec exposure of light-sensitive material 1.

From results shown in Table II, it can be understood that the change in sensitivity of the sensitizing dyes of the present invention was small even in the case of short period exposure by a flash lamp or laser light. Therefore, the light-sensitive material of the present invention is excellent in reciprocity law failure properties.

EXAMPLE 2

The same procedures as in Example 1 were repeated, except that instead of the dispersion of the yellow dye providing substance, a dispersion of a magenta dye providing substance (b) was used, and instead of the sensitizing dyes shown in Table I, sensitizing dyes according to the invention shown Table III were used, thereby preparing light-sensitive materials 6 to 9. They were exposed and processed in the same manner as in Example 1, and the results are shown in Table III. After another light-sensitive materials were kept for 3 days under conditions of 40° C. and a relative humidity of 80%, they were exposed and processed in the same manner as above. The results are also shown in Table III.

Magenta Dye Providing Substance (b)

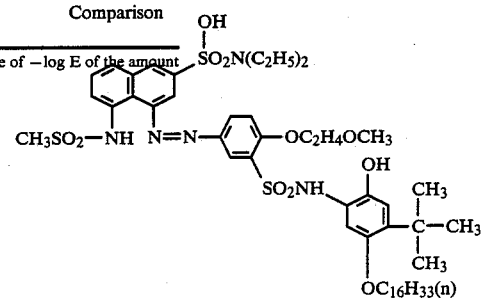

TABLE III

| Light-Sensitive Material | Sensitizing Dye | Immediately after Preparation Fogging | Immediately after Preparation Sensitivity* | After stored for 3 days at 40° C. and 80% RH Fogging | After stored for 3 days at 40° C. and 80% RH Sensitivity | Note |
|---|---|---|---|---|---|---|
| 6 | (2) | 0.18 | 1.0 | 0.24 | 0.95 | Invention |
| 7 | (6) | 0.20 | 0.95 | 0.26 | 0.90 | Invention |
| 8 | (12) | 0.24 | 0.90 | 0.27 | 0.80 | Invention |
| 9 | Comparative dye (a) | 0.26 | 0.95 | 0.30 | 0.60 | Comparison |

*The sensitivity was a relative value, based on the sensitivity of light-senstive material 6 as 1.0.

When the magenta dye providing substances were used, it can be understood form the results shown in Table III that, in the light-sensitive materials according to the present invention the reduction of sensitivity was small when the light-sensitive materials were stored, similar to the results of Example 1.

EXAMPLE 3

A silver halide emulsion (B) was prepared as follows.

Liquid III and liquid IV shown below were added to a well stirred aqueous gelatin solution (that contained 20 g of gelatin, 3 g of sodium chloride and 0.015 g of a compound,

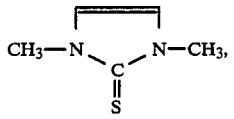

in 800 ml of water and was kept at 65° C.) over 70 min. At the beginning of the addition of liquid III and liquid IV, the addition of a dye solution containing 0.2 g of sensitizing dye (3) in a mixture of 150 cc of methanol and 150 cc of water was begun and the addition was continued over 60 min.

| | III (600 ml in all) | IV (600 ml in all) |
|---|---|---|
| $AgNO_3$ | 100 g | — |
| KBr | — | 56 g |
| NaCl | — | 7 g |

Immediately after the addition of liquid III and liquid IV, 2 g of KBr in 20 ml of water were added, and the mixture was allowed to stand for 10 min.

After washing to desalt the solution, 25 g of gelatin and 200 ml of water were added and the pH and the pAg were adjusted to 6.4 and 7.8, respectively. The emulsion obtained was a cubic monodisperse emulsion having a grain size of about 0.5 μm.

While this emulsion was kept at 60° C., 1.3 mg of triethyl thiourea, and 100 mg of 4-hydroxy-6-methyl-1,3,3a,7-tetraazaindene were simultaneously added thereto thereby chemically sensitizing the emulsion optimally. The yield was 650 g. This emulsion was named emulsion (B).

An organic silver salt (2) was prepared as follows.

20 g of gelatin and 5.9 g of 4-acetylaminophenylpropiolic acid were dissolved in 1,000 ml of an aqueous 0.1% sodium hydroxide solution and 200 ml of ethanol. The solution obtained was kept at 40° C. with stirring.

A solution of 4.5 g of silver nitrate in 200 ml of water was added to that solution over a period of 5 min.

The pH of the resulting dispersion was adjusted to take place sedimentation to remove the excess salt. Thereafter, the pH was adjusted to 6.3, and a dispersion of organic silver salt (2) with an yield of 300 g was produced.

A light-sensitive coating solution was prepared as

| | |
|---|---|
| (a) organic silver salt (2) | 20 g |
| (b) emulsion (B) | 10 g |
| (c) dispersion of the yellow dye providing substance prepared in Example 1 | 25 g |
| (d) aqueous 5% solution of the following compound: | 5 ml |

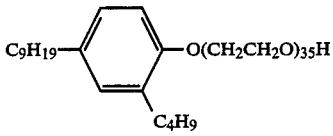

-continued

The above-mentioned ingredients were mixed, and a thickening agent and water were added thereto to bring the mixture to 100 ml. The solution was applied onto a polyethylene terephthalate film having a thickness of 180 μm to a wet thickness of 50 μm.

A protective layer coating composition was prepared as follows.

| | |
|---|---|
| (e) 10% gelatin | 400 g |
| (f) zinc hydroxide | 20 g |
| (g) aqueous 5% solution of the following compound: | 100 ml |

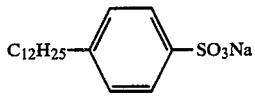

| | |
|---|---|
| (h) aqueous 5% solution of the following compound: $CH_2{=}CH{-}SO_2CH_2CONH(CH_2)_2NHCOCH_2SO_2CH{=}CH_2$ | 50 ml |

The above-mentioned ingredients were mixed, and a thickening agent and water added thereto to bring the composition to 100 ml.

The coating composition was applied on the above light-sensitive coating to a wet thickness of 30 μm followed by drying thereby producing light-sensitive material 10.

The same procedures as above were repeated, except that the sensitizing dye used in light-sensitive material 10 was replaced by sensitizing dyes shown in Table IV, thereby producing light-sensitive materials 11 and 12.

A dye fixing material was prepared as follows.

A dye fixing material was made by applying the following layers on a paper support laminated with polyethylene.

| | |
|---|---|
| Second layer | gelatin (0.7 g/m²) |
| | hardening agent*1 (0.24 g/m²) |
| First layer | gelatin (1.4 g/m²) |
| | mordant*2 (2.6 g/m²) |
| | quanidine picolinate (2.5 g/m²) |
| | Support |

*1 1,2-bis(vinylsulfonylacetamide)ethane

*2

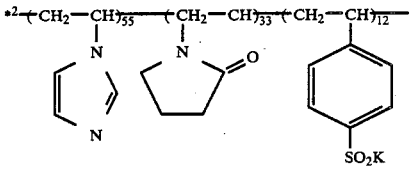

The light-sensitive materials were exposed imagewise for 1 sec at 5,000 luxes through an SC-50 filter using a tungsten lamp. Water in an amount of 15 ml/m² was supplied using a wire bar to the surface of each of the exposed light-sensitive materials, and the light-sensitive material and the dye fixing material were laminated so as the coated surfaces of each materials to be contacted. After heating them for 20 sec using a heat roller with a temperature adjusted so that the temperature of the film surface absorbing the water was 90° to 95° C., the dye fixing material was removed from the light-sensitive material to produce a yellow image.

In another test, after another light-sensitive materials were stored for 3 days at 50° C., they were exposed and processed in the same manner as above. The results are shown in Table IV.

TABLE IV

| Light-Sensitive Material | Emulsion | Sensitizing Dye | Immediately after Preparation Fogging | Immediately after Preparation Sensitivity* | After stored at 50° C. for 3 days Fogging | After stored at 50° C. for 3 days Sensitivity | Note |
|---|---|---|---|---|---|---|---|
| 10 | B | (3) | 0.19 | 1.0 | 0.20 | 0.85 | Invention |
| 11 | B | (18) | 0.20 | 0.95 | 0.22 | 0.70 | Invention |
| 12 | B | Comparative dye (a) | 0.20 | 0.65 | 0.26 | 0.20 | Comparison |

*The sensitivity is expressed as a relative value of log, based on the value of light-sensitive material 10 as 1.0.

From the results shown in Table IV, it can be understood that in comparison to comparative light-sensitive material 12, in the light-sensitive materials 10 and 11 according to the present invention, the decrease in sensitivity and the increase in fogging after storage were small, and the storage stability was good even when the process of preparation of the light-sensitive materials and the method of processing the light-sensitive materials were changed.

While the invention has been described in detail and with reference to specific embodiments thereof, it will be apparent to one skilled in the art that various changes and modifications can be made therein without departing from the spirit and scope thereof.

What is claimed is:

1. A heat-developable light-sensitive material comprising a support having provided thereon a light-sensitive layer comprising a silver halide which is spectrally sensitized with at least one dye represented by the formula (I):

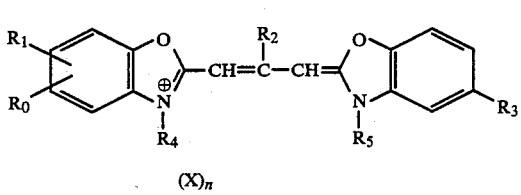

(I)

wherein $R_0$ and $R_1$, which may be the same or different, each represents a hydrogen atom, an alkyl group, an aryl group, an alkoxy group, an aryloxy group, a halogen atom, an alkoxycarbonyl group, an acylamino group, an acyl group, a cyano group, a carbamoyl group, a sulfamoyl group, a carboxyl group, or an acyloxy group; provided that at least one of $R_0$ and $R_1$ represents a group other than a hydrogen atom; $R_2$ represents a hydrogen atom, an alkyl group, or an aryl group; $R_3$ represents an alkyl group containing at least two carbon atoms, an acyloxy group containing at least three carbon atoms, or an alkoxycarbonyl group containing at least four carbon atoms: the group represented by $R_3$ has a value of S of 544 or less wherein S is represented by formula (Z):

$$S=3.536L-2.661B+535.4 \quad \text{(Z)}$$

wherein L represents the length of the group $R_3$ along the axis of the bond between the group $R_3$ and the center of the benzene nucleus to which the group $R_3$ is connected, and B represents the smaller value of $B_1+B_4$ and $B_2+B_3$ wherein $B_1$, $B_2$, $B_3$, and $B_4$ each represents the width of the group $R_3$ which are measured at their maximum points and perpendicular to said axis and each other, provided that $R_1$ is the smallest value and $R_2$, $R_3$, and $R_4$ are successively larger; $R_4$ and $R_5$, which may be the same or different, each represents an alkyl group; X represents an anion; and n is 0 or 1, as required to satisfy charge balance, wherein said heat-developable light-sensitive material contains a dye providing substance represented by formula (LI): Dye-$X_n$-Y; and a reducing substance, with the proviso that said reducing substance may be said dye providing substance when said dye providing substance has reducing ability, and wherein in said general formula (LI) Dye represents a dye moiety, a dye moiety in which the absorption wavelength is temporarily shifted to the short wavelength region, or a dye precursor group; X represents a bond or linking group; Y represents a group which alters the diffusibility of the compound represented by general formula (LI) corresponding to or counter-corresponding to a light-sensitive silver salt having a latent image or a group which releases Dye and provides a difference in diffusibility between the released Dye and (Dye-X)$_n$-Y, and n is 1 or 2, and when n is 2, the two Dye-X moieties may be the same or different.

2. A heat-developable light-sensitive material as claimed in claim 1, wherein said alkyl group represented by $R_0$ and $R_1$ is a substituted or unsubstituted alkyl group containing up to 10 carbon atoms; said aryl group represented by $R_0$ and $R_1$ is a substituted or unsubstituted aryl group containing up to 10 carbon atoms; said alkoxy group represented by $R_0$ and $R_1$ is a substituted or unsubstituted alkoxy group containing up to 10 carbon atoms; said aryloxy group represented by $R_0$ and $R_1$ is a substituted or unsubstituted aryloxy group containing up to 10 carbon atoms; said halogen atom represented by Re and $R_1$ is a fluorine atom, a chlorine atom, a bromine atom or an iodine atom; said alkoxycarbonyl group represented by $R_0$ and $R_1$ is a substituted or unsubstituted alkoxycarbonyl group containing up to 10 carbon atoms; said acylamino group represented by $R_0$ and $R_1$ is a substituted or unsubstituted acylamino group containing up to 8 carbon atoms; said acyl group represented by $R_0$ and $R_1$ is a substituted or unsubstituted acyl group containing up to 10 carbon atoms; said carbamoyl group represented by $R_0$ and $R_1$ is a substituted or unsubstituted carbamoyl group containing up to 6 carbon atoms; said sulfamoyl group represented by $R_0$ and $R_1$ is a substituted or unsubstituted sulfamoyl group containing up to 6 carbon atoms; and said acyloxy group represented by $R_0$ and $R_1$ is a substituted or unsubstituted acyloxy group containing up to 10 carbon atoms.

3. A heat-developable light-sensitive material as claimed in claim 2, wherein one of $R_0$ and $R_1$ is substituted at the 5-position of the benzoxazole ring and the other is substituted at the 6-position of the benzoxazole ring of formula (I).

4. A heat-developable light-sensitive material as claimed in claim 3, wherein $R_0$ represents a hydrogen atom and $R_1$ represents a phenyl group substituted at the 5-position of the benzoxazole ring of formula (I).

5. A heat-developable light-sensitive material as claimed in claim 1, wherein said alkyl group represented by $R_2$ is a substituted or unsubstituted alkyl group containing up to 4 carbon atoms, and said aryl group represented by $R_2$ is a substituted or unsubstituted aryl group containing up to 10 carbon atoms.

6. A heat-developable light-sensitive material as claimed in claim 6, wherein $R_3$ represents an ethyl group, a propyl group, an isopropyl group, a t-butyl group, a t-pentyl group, a cyclohexyl group, a t-octyl group or a benzyl group.

7. A heat developable light-sensitive material as claimed in claim 1, wherein said group represented by $R_3$ has a value of S of from 500 to 544.

8. A heat-developable light-sensitive material as claimed in claim 1, wherein said alkyl group represented by $R_4$ and $R_5$ is an unsubstituted alkyl group containing up to 8 carbon atoms; an aralkyl group containing up to 10 carbon atoms; or a substituted alkyl group containing up to 6 carbon atoms, substituted with a substituent selected from the group consisting of a hydroxyl group, a carboxyl group, a sulfo group, a cyano group, a halogen atom, an alkoxycarbonyl group containing up to 8 carbon atoms, an alkoxy group containing up to 8 carbon atoms, an aryloxy group containing up to 8 carbon atoms, an acyloxy group containing up to 8 carbon atoms, an acyl group containing up to 8 carbon atoms, a carbamoyl group containing up to 6 carbon atoms, a sulfamoyl group containing up to 6 carbon atoms, and an aryl group containing up to 10 carbon atoms.

9. A heat developable light-sensitive material as claimed in claim 1, wherein said anion represented by X is a chloride ion, a bromide ion, an iodide ion, a p-toluene sulfonate ion, a p-nitrobenzene sulfonate ion, a methane sulfonate ion, a methyl-sulfate ion, an ethylsulfate ion, a 1,3-naphthalene disulfonate ion, or a perchlorate ion.

10. A heat-developable light-sensitive material as claimed in claim 1, wherein said light-sensitive layer contains from about $10^{-8}$ to $10^{-2}$ mol of said dye per mol of said silver halide.

11. A heat-developable light-sensitive material in claim 10, wherein said light-sensitive layer contains from about $10^{-7}$ to $10^{-4}$ mol of said dye per mol of said silver halide.

12. A heat-developable light-sensitive material as claimed in claim 1, wherein said light-sensitive layer further comprises from about 0.01 to 10 mol of an organic silver salt per mol of said silver halide, the total amount of silver in said silver halide and said organic silver salt being from about 50 mg/m$^2$ to 10 g/m$^2$ of said light-sensitive layer.

13. A heat-developable light-sensitive material as claimed in claim 1, further comprising a dye-fixing layer comprising a mordant and a binder.

14. A heat-developable light-sensitive material as claimed in claim 13, wherein said dye-fixing layer comprises at least one of a base and a base precursor.

15. A heat-developable light-sensitive material as claimed in claim 1, further comprising at least one layer containing an image formation accelerating agent.

16. A heat-developable light-sensitive material as claimed in claim 1, further comprising a dye-fixing material comprising a support having thereon a dye-fixing layer comprising a mordant and a binder, said dye-fixing layer being disposed in face-to-face relation with the outermost layer on said support having thereon said light-sensitive layer.

17. A heat-developable light-sensitive material as claimed in claim 17, wherein at least one layer of said light-sensitive material disposed on said support having thereon said light-sensitive layer comprises a sparingly water-soluble metal compound, and at least one layer of said dye-fixing material comprises a compound capable of forming a complex with said metal contained in said sparingly water-soluble metal compound to release a base.

18. Method for forming an image comprising heat developing a heat-developable light-sensitive material after or simultaneously with imagewise exposure thereof, wherein said heat-developable light-sensitive material comprises a support having provided thereon a light-sensitive layer comprising a silver halide which is spectrally sensitized with at least one dye represented by formula (I):

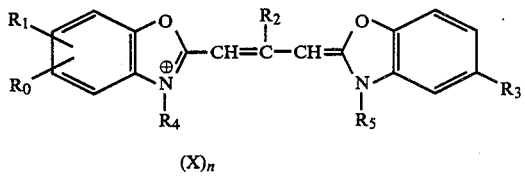

(I)

wherein $R_0$ and $R_1$, which may be the same or different, each represents a hydrogen atom, an alkyl group, an aryl group, an alkoxy group, an aryloxy group, a halogen atom, an alkoxycarbonyl group, an acylamino group, an acyl group, a cyano group, a carbamoyl group, a sulfamoyl group, a carboxyl group, or an acyloxy group; provided that at least one of $R_0$ and $R_1$ represents a group other than a hydrogen atom; $R_2$ represents a hydrogen atom, an alkyl group, or an aryl group; $R_3$ represents an alkyl group containing at least two carbon atoms, an acyloxy group containing at least three carbon atoms, or an alkoxycarbonyl group containing at least for carbon atoms; the group represented by $R_3$ has a value of S or 544 or less wherein S is represented by formula (Z):

$$S=3.536L-2.661B+535.4 \quad (Z)$$

wherein L represents the length of the group $R_3$ along the axis of the bond between the group $R_3$ and the center of the benzene nucleus to which the group $R_3$ is connected, and B represents the smaller value of $B_1+B_4$ and $B_2+B_3$ wherein $B_1$, $B_2$, $B_3$, and $B_4$ each represents the width of the group $R_3$ which are measured at their maximum points and perpendicular to said axis and each other, provided that $B_1$ is the smallest value and $B_2$, $B_3$, and $B_4$ are successively larger; $R_4$ and $R_5$, which may be the same or different, each represents an alkyl group; X represents an anion; and n is 0 or 1, as required to satisfy charge balance.

19. A heat-developable light-sensitive material as claimed in claim 1, wherein said light-sensitive material further comprises an organic silver salt.

20. A heat-developable light-sensitive material as claimed in claim 1, wherein said light-sensitive material further comprises a base and/or a base precursor.

21. A heat-developable material as claimed in claim 20, wherein said base precursor is a sparingly soluble metal compound capable of releasing a base by reacting with a complex forming compound in the presence of water.

* * * * *